US010561996B2

(12) United States Patent
Ziesel et al.

(10) Patent No.: US 10,561,996 B2
(45) Date of Patent: Feb. 18, 2020

(54) FLUID DISPENSER CHASSIS AND AGITATION SYSTEM

(71) Applicant: THE COCA-COLA COMPANY, Atlanta, GA (US)

(72) Inventors: Lawrence Blair Ziesel, Woodstock, GA (US); Daniel S. Quartarone, Stone Mountain, GA (US); David J. Harvey, Suwanee, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 237 days.

(21) Appl. No.: 15/307,177

(22) PCT Filed: Apr. 29, 2015

(86) PCT No.: PCT/US2015/028306
§ 371 (c)(1),
(2) Date: Oct. 27, 2016

(87) PCT Pub. No.: WO2015/168293
PCT Pub. Date: Nov. 5, 2015

(65) Prior Publication Data

US 2017/0050156 A1 Feb. 23, 2017

Related U.S. Application Data

(60) Provisional application No. 61/987,386, filed on May 1, 2014.

(51) Int. Cl.
*B01F 11/00* (2006.01)
*B67D 1/00* (2006.01)
(Continued)

(52) U.S. Cl.
CPC ..... *B01F 11/0008* (2013.01); *B01F 13/1022* (2013.01); *B01F 15/00253* (2013.01);
(Continued)

(58) Field of Classification Search
CPC ..... B01F 11/0008; B01F 13/1022; B01F 15/00253; B01F 15/0283;
(Continued)

(56) References Cited

U.S. PATENT DOCUMENTS 4,356,937 A 11/1982 Simon et al.
5,341,957 A 8/1994 Sizemore
(Continued)

FOREIGN PATENT DOCUMENTS

EP 0315439 A2 5/1989
EP 2479137 A1 7/2012

OTHER PUBLICATIONS

Lee, Jong Kyung; International Search Report and Written Opinion; dated Aug. 7, 2015; pp. 1-10; Korean Intellectual Property Office; Daejeon Metropolitan City, Korea.
(Continued)

*Primary Examiner* — Anshu Bhatia

(57) ABSTRACT

Agitating a plurality of fluid packages in a tower. The housing tower may include a stationary tower as well as an agitation device. The agitation device may include an agitation chassis assembly and an agitation rack tower. The plurality of fluid packages may be received at the agitation rack tower. Once received, the plurality of fluid packages may be connected to a pump assembly, wherein the pump assembly is located at the agitation chassis assembly. In addition, the agitation rack tower may be agitated relative to the agitation chassis assembly about a pivot point located on the agitation rack tower.

6 Claims, 6 Drawing Sheets

(51) Int. Cl.

| | |
|---|---|
| ***B67D 1/08*** | (2006.01) |
| ***B01F 13/10*** | (2006.01) |
| ***B01F 15/00*** | (2006.01) |
| ***B01F 15/02*** | (2006.01) |

(52) U.S. Cl.
CPC ..... *B01F 15/0283* (2013.01); *B67D 1/0035* (2013.01); *B67D 1/0041* (2013.01); *B67D 1/0043* (2013.01); *B67D 1/0078* (2013.01); *B67D 1/0888* (2013.01); *B01F 2215/0022* (2013.01); *B67D 2210/00034* (2013.01); *B67D 2210/00163* (2013.01)

(58) Field of Classification Search
CPC ..... B01F 2215/0022; B67D 1/0035; B67D 1/0041; B67D 1/0043; B67D 1/0078; B67D 1/0888; B67D 2210/00034; B67D 2210/00163
USPC ..... 366/110, 208–218
See application file for complete search history.

(56) References Cited

U.S. PATENT DOCUMENTS

| | | | | |
|---|---|---|---|---|
| 7,832,921 | B2 * | 11/2010 | Malin | A61B 10/0096 366/208 |
| 8,220,667 | B1 | 7/2012 | Butcher et al. | |
| 8,322,570 | B2 * | 12/2012 | Beavis | A47J 31/36 222/129.1 |
| 2004/0065681 | A1 | 4/2004 | Floyd et al. | |
| 2004/0170082 | A1 * | 9/2004 | Heeg | C12M 23/48 366/110 |
| 2007/0125795 | A1 | 6/2007 | Emes et al. | |
| 2008/0299652 | A1 * | 12/2008 | Owen | B01F 11/0008 435/303.3 |
| 2010/0005903 | A1 | 1/2010 | Beavis | |

OTHER PUBLICATIONS

Muller, Claus; Supplementary European Search Report; dated Dec. 1, 2017; pp. 1-8; European Patent Office; Munich, Germany.

* cited by examiner

FLUID DISPENSER CHASSIS AND AGITATION SYSTEM

This application is a U.S. National stage application of PCT/US2015/028306, which was filed on Apr. 29, 2015, as a PCT International Patent application and claims priority to U.S. Provisional patent application No. 61/987,386, filed May 1, 2014, the entire disclosures of which are incorporated by reference in their entirety.

BACKGROUND

Fluid packages may typically be housed within an ingredient tower. The ingredient tower may include a corresponding number of pumps and valves for each of the fluid packages. In addition, the ingredient tower may include a corresponding number of sensors to monitor and measure the amount of fluid that is pumped from the fluid packages.

The fluid packages may require agitation to keep the ingredients mixed. Typically, the entire ingredient tower may be agitated to mix the fluid packages. The agitation of the entire ingredient tower often results in an unintended agitation of the corresponding pumps, valves, sensors, and any associated electrical harnesses and wiring. This unintended agitation may contribute to electrical and mechanical malfunction requiring frequent repair, costly maintenance and replacement.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

The agitation of a plurality of fluid packages utilizing a housing tower may be provided. The housing tower may include a stationary tower as well as an agitation device. The agitation device may include an agitation chassis assembly and an agitation rack tower. The plurality of fluid packages may be received at the agitation rack tower. Once received, the plurality of fluid packages may be connected to a pump assembly, wherein the pump assembly is located at the agitation chassis assembly. The agitation rack tower may be oscillated relative to the agitation chassis assembly about a pivot point located on the agitation rack tower to refrain from agitating the pump assembly.

These and other features and advantages will be apparent from a reading of the following detailed description and a review of the associated drawings. It is to be understood that both the foregoing general description and the following detailed description are illustrative only and are not restrictive of the invention as claimed.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1:
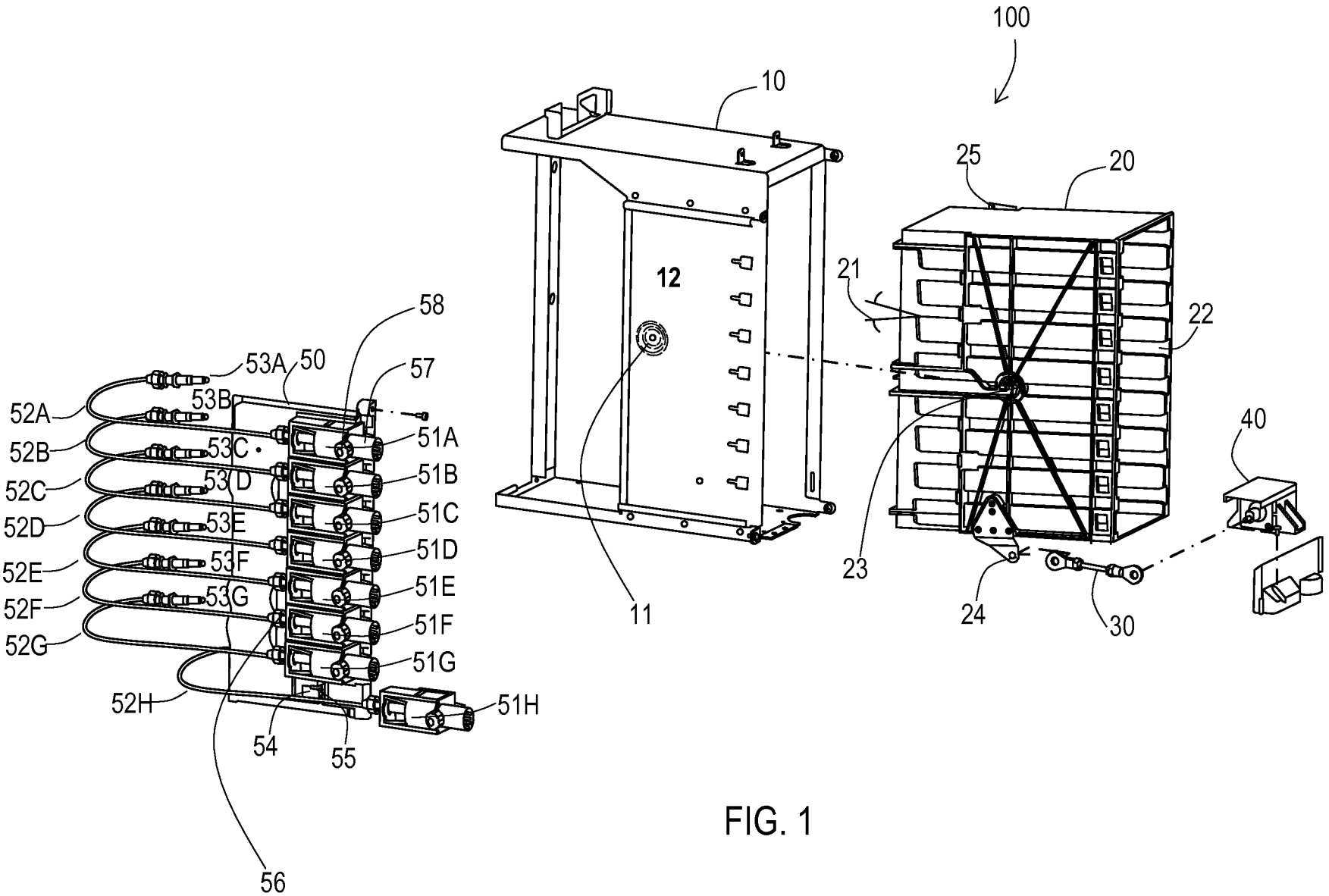
FIG. 1 is a diagram of an exemplary operating environment for agitating fluid packages as is described herein.

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Figure 2:
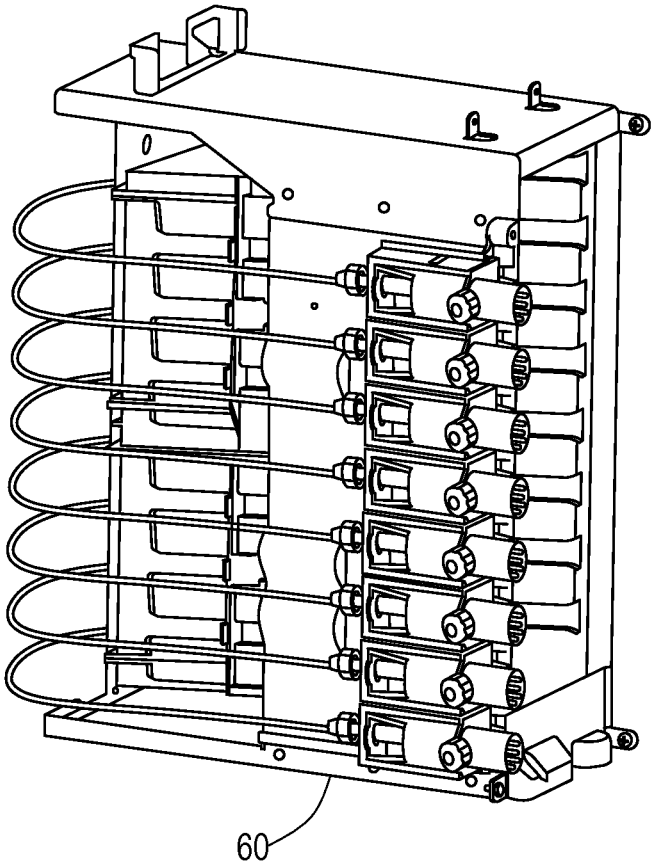
FIG. 2 is a schematic view of an agitation device as is described herein.

FIG. 1 is a schematic view of an exemplary operating environment 100 for agitating a plurality of fluid packages or containers. As shown in FIG. 1, the operating environment 100 may comprise an agitation chassis assembly 10, an agitation rack tower 20, a connecting rod 30, an agitation motor mount 40, and a pump assembly 50. As shown in FIG. 2, the operating environment 100 may be assembled as an agitation device 60. The agitation rack tower 20 may include a plurality of fluid sources.

The plurality of fluid sources may include, for example, fluid packages or containers that are inserted within the agitation rack tower 20. The fluid packages may contain a colloid, typically an emulsion. In some examples, the fluid packages may have beverage forming ingredients therein and act as beverage forming ingredient sources. In such scenarios, the fluid in the fluid packages can be used to form beverages such as teas, soft drinks, sport drinks, fruit drinks, and the like. In other examples, other types of fluids can be contained in the fluid packages and be used to form other beverages.

The agitation rack tower 20 may have slots 22 to physically receive the fluid packages. In some embodiments, to enable receipt of the maximum number of fluid packages, the agitation rack tower 20 may omit dividers between the packages. Instead, each fluid package may be stacked within the agitation rack tower 20 package to package in the slots 22. In some embodiments, fluid packages may be inserted into the slots 22 in a drawer. Such fluid packages and drawers are described in commonly owned patent application Ser. No. 14/209,684 titled "Beverage Dispenser Container and Carton," hereby incorporated by reference in its entirety.

Figure 6:
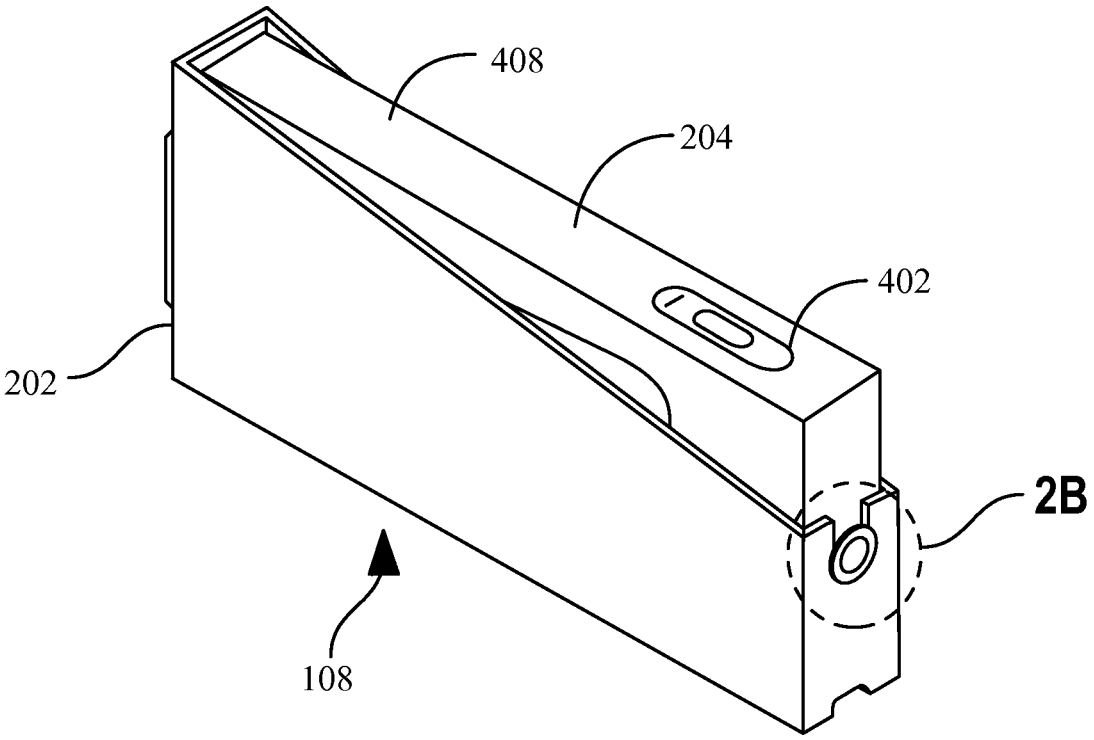
FIG. 6 is a schematic view of an example fluid package as is described herein.

For example, one non-limiting embodiment of a fluid package 108 is shown in FIG. 6. The fluid package 108 includes a carton 204 with a bag positioned therein with a fluid. The carton 204 includes a product label 402. In this example, the product label 402 includes an RFID tag embedded therein positioned on a side 408 of the carton 204. The carton 204 is held by a container 202 that is sized to be positioned within the agitation rack tower 20 as described herein.

Referring again to FIG. 1, the agitation device 60 may agitate the plurality of fluid packages to keep the contents from stratifying or otherwise settling and/or separating. For example, the contents may stratify when the fluid packages have remained stationary for a set period of time. The fluid packages may be agitated within the agitation rack tower 20. The agitation chassis assembly 10 may remain stationery as the agitation rack tower 20 oscillates about an agitation rack tower pivot point 23 relative to an agitation chassis assembly pivot 11. The agitation rack tower 20 may be agitated via an agitation motor mount pivot point 24. The agitation motor mount pivot point 24 may be connected to the agitation motor mount 40 via the connecting rod 30. As the agitation motor mount 40 is actuated it may cause the agitation motor mount pivot point 24 to oscillate via the connecting rod 30.

The agitation rack tower 20 may oscillate about the agitation rack tower pivot point 23 relative to the agitation chassis assembly pivot 11. The agitation motor mount 40 may be a conventional electric motor or any other type of conventional drive device. For example, the motor agitation mount 40 may be a stepper motor, a switched reluctance motor, or an induction motor. The agitation rack tower 20 may be agitated up to plus-or-minus ten degrees about the agitation rack tower pivot point 23 at varying ranges. More specifically, the agitation rack tower 20 may be agitated up to plus-or-minus four degrees about the agitation rack tower pivot point 23. The agitation rack tower 20 may be agitated at ranges of 1, 10, 100, 1000 Hertz or higher, or frequencies less than 1 Hertz. In an alternative embodiment, the fluid packages may be agitated utilizing piezo electric, or pendulum motion agitation.

The agitation rack tower 20 may secure each of the plurality of fluid packages at an angle 21 to ensure improved evacuation of the fluid from the fluid packages. The overall height of the tower may be confined to a predefined height. Furthermore, a predefined number of fluid packages may be desired. Therefore, the angle 21 must be able to accommodate the improved evacuation, predefined tower height, and predefined number of fluid packages. For example, each of the fluid packages may be stored at a five degree angle 21 with respect to a top surface of the agitation rack tower 20. Other angles greater than zero degrees and less than or equal to 90 degrees may be used.

Each of the fluid packages may be connected to an individual pump 51A-51H within the pump assembly 50 via product tubes 52A-52G. The product tubes 52A-52G may include packaging connectors 53A-53G for providing fluid communication between the fluid packages and the product tubes. The packaging connectors 53A-53G may be a fitment engaging probe, a bag-in-box connector or other such connector. The fluid packages may likewise include a fitment (see, e.g., 2B shown in FIG. 6) adapted to engage with one or more of the packaging connectors 53A-53G. In an embodiment, the agitation rack tower 20 may include eight fluid packages and eight associated pumps. Other numbers of packages and pumps may be used. When a fluid package is installed in the agitation rack tower 20, the package fitment may be located at a lower end of the slots 22 of the agitation rack tower 20 such that gravity draws fluid in each fluid package toward the package fitment due to the angle 21 of the slots.

The pumps may each include a back pressure modulation device 57. The back pressure modulation device 57 may be utilized for regulating back pressure on the pump. Each individual pump 51A-51G may be located below the fluid package fitment to enable the fluid within the packages to drain. For example, because each individual pump 51A-51G is below the package fitment, the fluid contained therein is able to drain and prime the individual pump 51A-51H using gravity. Therefore, the input to the pumps 51A-51G is always wet (e.g., the pumps 51A-51G don't have to pump air to prime the lines). However, the lowest fluid package's associated pump 51H may not be below the package fitment due to space restriction within the agitation device 60. Positioning the individual pump 51A-51G below the package fitment may also force any air within the tubing to flow back within the fluid package.

In one embodiment, there may be a relationship between a particular fluid package and one or more respective pumps 51A-51H. For example, there may be a one-to-one relationship between a particular fluid package and a pump 51A-51H. As another example, there may be a one-to-many relationship between a particular fluid package and associated pumps 51A-51H. A wide variety of relationships between a particular fluid and associated pump(s) 51A-51H may be utilized as desired in various embodiments of the invention. The utilization of more than one pump 51A-51H for drawing fluid from a fluid package may facilitate the ability to draw a higher volume of a fluid from a fluid package in a given period of time. For fluid packages that are fluids, it may be desirable to use a plurality of pumps 51A-51H to be able to draw a higher volume of an ingredient (e.g., a sweetener) from the package in a given period of time.

With continued reference to FIG. 1, the pump assembly 50 may include a plurality of pumps 51A-51H connected to a pump assembly control board 54 via power and data connections 55. The fluid drawn from the fluid packages may be delivered to a nozzle (not shown) via a pump outlet 58 and tubing (not shown) that provides fluid communication between the pump outlet and the nozzle. The pump power and data connections 55 may be utilized to physically connect and hold the pump in place.

The pump assembly 50 may be attached to the agitation chassis assembly 10 at surface 12. The agitation chassis assembly 10 may remain stationery as the agitation rack tower 20 oscillates relative to the agitation chassis assembly 10. Accordingly, the pump assembly 50 may remain stationary while the agitation rack tower 20 oscillates. The surface 12 may face away from the agitation rack tower 20 to protect the pump assembly 50 from potential fluid leaks and package ruptures. In some embodiments, the pump assembly 50 may be located separate from the agitation device 60, such as on a door or housing that may enclose the agitation device 60.

In one embodiment, inserting the correct fluid package into one of the slots 22 of the agitation rack tower 20 may be double checked or otherwise verified by scanning a machine readable code on the package. A machine readable code reader, such as a radio frequency identification (RFID) antenna 25, may be utilized to read an RFID tag prior to, during, and/or subsequent to its insertion into the agitation rack tower 20. In this regard, the RFID antenna 25 may be used to obtain information related to or associated with the fluid package, and use such information to identify or otherwise determine the location within the agitation rack tower 20 of the fluid package. The RFID antenna 25 may be highly sensitive to displacement with respect to the fluid packages.

Therefore, the RFID antenna 25 may be securely affixed to the agitation rack tower 20 and coupled to an RFID control board with an RFID reader thereon. The RFID antenna 25 may be securely connected to the RFID control board via a flexible electrical connector, such as, for example, a coaxial cable. Although the RFID antenna 25 is located on the agitation rack tower 20, only the antenna is agitated. The RFID control board may be attached to the agitation chassis assembly 10 or other stationary attachment surface within reach of the flexible electrical connector. Other types of readers can be used.

In one example, the power and data connections 55 may be segregated from the RFID antenna 25 to reduce noise and interference. For example, in the depicted embodiment, the power and data connections 55 are located at a first side 41 of the agitation rack tower 20, and the RFID antenna 25 is located at a second side 43 of the agitation rack tower 20. By separating the radio frequency electronics from the power electronics, any electronic noise and interference may be reduced or eliminated.

Furthermore, the RFID antenna 25 is located near the second side 43 of the agitation rack tower 20 to enable an RFID tag in the fluid packages to be directed towards the RFID antenna 25. For example, a fluid package may include an RFID tag on the side (see RFID tag 402 on side 408 of the fluid package 108). Therefore, after loading the fluid package in the agitation rack tower 20, the RFID tag may be pointed towards the antenna located on the right side of the agitation chassis assembly 10.

An RFID antenna 25 may also be located between the agitation device 60 and a stationary device, such as the stationary tower 61 described below. Mounting the RFID antenna 25 to the stationary tower 61 and adjacent to the agitation device 60 allows the RFID antenna 25 to performed desired reads from RFID tags held by fluid packages within the agitation device 60 while avoiding unintended agitation as only the agitation rack tower 20 is agitated.

Figure 4:
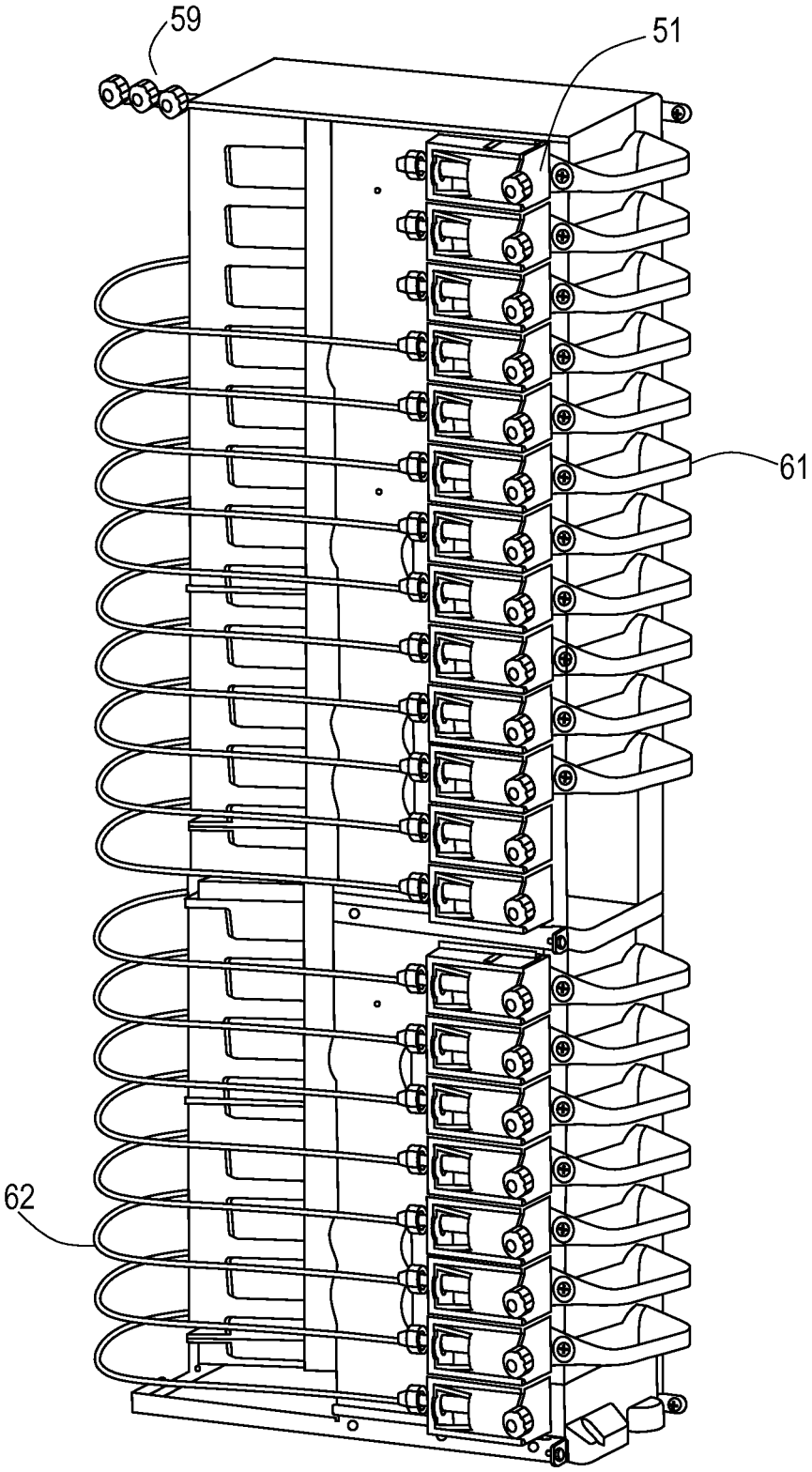
FIG. 4 is a schematic view of an agitation device-stationary device configuration as is described herein.

FIG. 2 is a schematic view of the agitation device 60 in more detail consistent with embodiments of the disclosure. The agitation device 60 may agitate the plurality of fluid packages to keep the fluid packages from stratifying. As shown in FIG. 2, there may be a single agitation device 60. In an alternative embodiment, there may be multiple agitation devices located directly on top of one another or stacked adjacent to each other, as depicted in FIG. 4.

Figure 3:
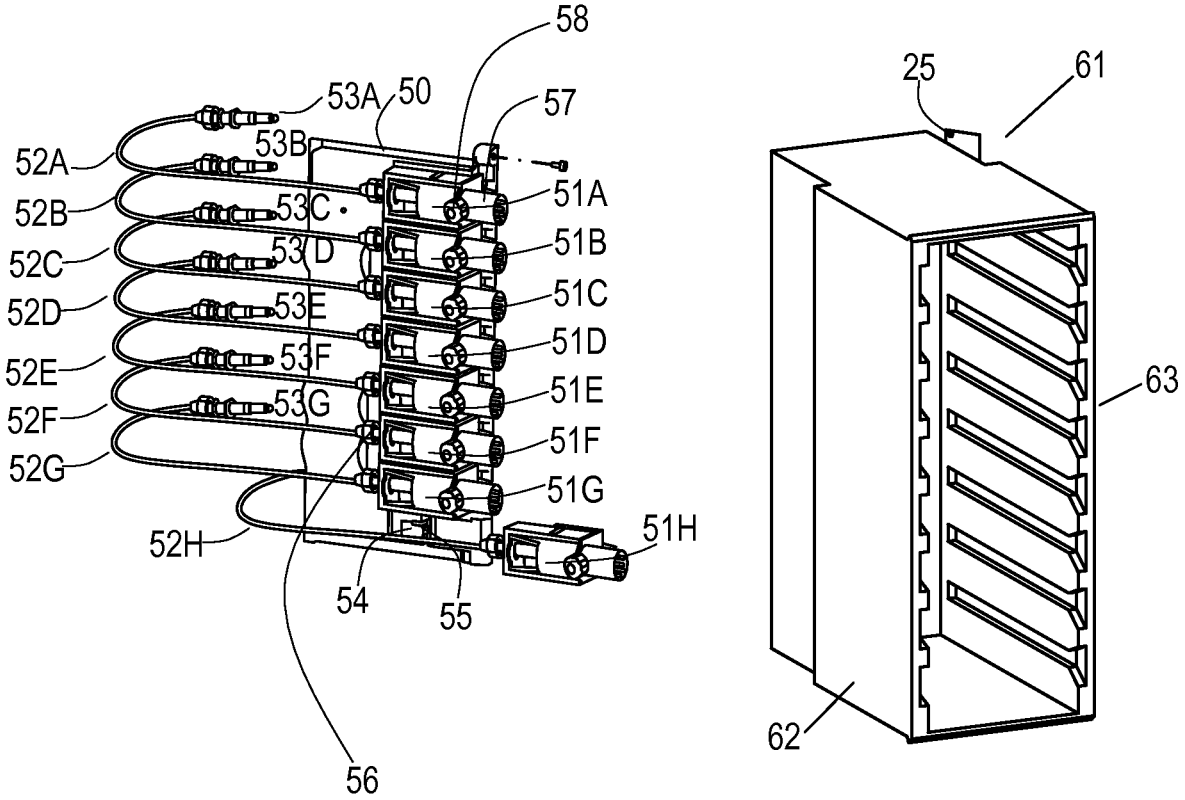
FIG. 3 is a schematic view of a stationary tower as is described herein.

FIG. 3 is a schematic view of a stationary tower 61 in more detail consistent with embodiments of the disclosure. The stationary tower 61 may house a plurality of fluid packages that do not require agitation. The stationary tower 61 may include a housing 62 and a plurality of fluid slots 63. As shown in FIG. 3, there may be a single stationary tower 61. In an alternative embodiment, there may be multiple stationary towers located directly on top of one another, as depicted in FIG. 4.

The stationary tower 61 may generally be configured in a manner similar to the agitation rack tower 20 described above, including a pump assembly 50.

A machine readable code reader, such as the radio frequency identification (RFID) antenna 25 described above, may be utilized to read an RFID tag prior to, during, and/or subsequent to its insertion into the stationary tower 61. In this regard, a RFID antenna 25 may be used to obtain information related to or associated with the fluid, and use such information to identify or otherwise determine the location within the stationary tower 61 of the fluid package. The RFID antenna 25 may be highly sensitive to displacement with respect to the fluid packages. Therefore, the RFID antenna 25 may be securely affixed to the stationary tower 61 and coupled to an RFID control board located near or at the pump assembly control board 54. The RFID antenna 25 may be securely connected to the RFID control board via a flexible electrical connector, such as, for example, a coaxial cable.

FIG. 4 is a schematic view of an agitation device (e.g., agitation rack tower 20)-stationary device (e.g., stationary tower 61) configuration consistent with embodiments of the disclosure. There may be multiple towers located directly on top of one another to form a higher tower. Both towers may include a plurality of fluid packages. In alternative designs, two or more agitation rack towers 20 can be positioned on top of one another, or two or more stationary towers 61 can be positioned on top of one another. Further, a mixture of one or more agitation rack towers 20 and stationary towers 61 can be combined.

As depicted, the top ingredient tower is the stationary tower 61, allowing its plurality of fluid packages to remain stationary. The stationary tower 61 may include a different configuration in comparison to the agitation rack tower 20. For example, the stationary tower may include a single housing apparatus to house the plurality of fluid packages, rather than both an agitation chassis assembly 10 and an agitation rack tower 20. In addition, the stationary tower may be a standalone ingredient tower for fluid packages that only have ingredients that don't require agitation. Furthermore, the stationary tower may be stacked upon another stationary tower. The agitation rack tower 20 and the stationary tower 61 can be configured as described above.

In one embodiment, there may be a relationship between a particular beverage forming ingredient package and one or more respective pumps. For example, there may be a one-to-one relationship between a particular beverage forming ingredient package and a pump. As another example, an ingredient manifold 59 may enable a four-to-one relationship between a particular beverage forming ingredient package and associated pumps. A wide variety of relationships between a particular beverage forming ingredient package and associated pump(s) and/or valve(s) may be utilized as desired in various embodiments of the invention. The utilization of more than one pump may facilitate the ability to draw a higher volume of a beverage ingredient from a beverage forming ingredient package in a shorter period of time. In a few cases, it may be desirable to utilize a plurality of pumps on a single ingredient to be able to draw a higher volume of liquid from the package in a shorter period of time. One such ingredient in which it may be desirable to use a plurality of pumps to be able to draw a higher volume of liquid from the package in a shorter period of time can be the sweetener.

The stationary tower 61 may secure each of the plurality of fluid packages at an angle to improve evacuation, as described above. For example, each of the plurality of fluid packages may be stored at one of a plurality of angles, such as a five degree angle. In this embodiment, the stationary tower 61 includes eight fluid packages and eight associated pumps, although more or less can be provided.

The package fitment may be located near the rear of the stationary tower 61 to permit probes and connected tubing access to the plurality of fluid packages. Each individual pump may be located below the respective fluid package outlet to enable the contents within the packages to drain utilizing normal forces. For example, because each individual pump is below the package outlet, the fluids are able to drain and prime the corresponding individual pump using gravity. Therefore, the input to the pumps is always wet (e.g., the pumps don't have to pump air to prime the lines). However, the lowest fluid package's associated pump may not be below the package outlet due to space restriction within the stationary tower 61.

Positioning the individual pump below the package outlet may also force any air within tubing to flow back within the fluid package. In addition, each individual pump may have its own quick connect snap-in mechanism to enable efficient connection of the pump with a fluid package via the probes.

The quick connect snap-in mechanism may also be configured to efficiently connect the tubing between an individual pump within the pump assembly 50 and a fluid package. Furthermore, the tubing may include varying diameters. For example, the inlet of the tubing at the fluid package may have a larger diameter, whereas the outlet of the tubing at the pump may have a smaller diameter.

The plurality of fluid packages that are agitated may contain emulsions, whereas the plurality of fluid packages that are not agitated may contain solutions. In some embodiments, the emulsions may include brand specific beverage forming content. In other embodiments, the emulsions may include flavor content such as, for example, a cola flavor, a cherry flavor, and a vanilla flavor. In such an embodiment, the variety of fluid packages may include, but is not limited to, cola flavor, cherry flavor, cherry and vanilla flavor, and vanilla flavor. Therefore, the stationary tower 61 may include a plurality of beverage forming flavor solutions. Whereas, the agitation device 60 may include a plurality of fluid emulsions.

Figure 5:
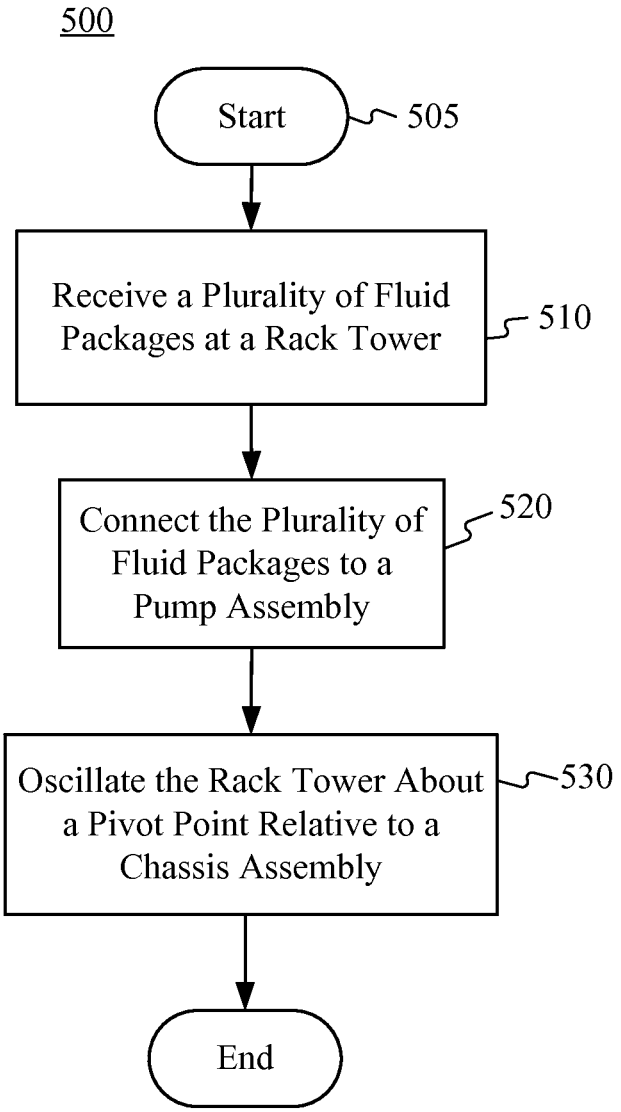
FIG. 5 is a flow chart of a method for agitating the fluid packages as is described herein.

FIG. 5 is a flow chart setting forth the general stages involved in a method 500 consistent with an embodiment of the disclosure for agitating fluid packages. Method 500 may be implemented using an agitation chassis assembly 10, an agitation rack tower 20, a connecting rod 30, an agitation motor mount 40, and a pump assembly 50 as described in more detail above with respect to FIG. 1-2.

Method 500 may begin at operation 505 and proceed to operation 510 where a plurality of fluid packages may be received. The agitation rack tower 20 may have slots 22 to physically receive the plurality of fluid packages. The agitation rack tower 20 may have slots 22 to physically receive the fluid packages.

From operation 510, where the plurality of fluid packages may be received, method 500 may advance to operation 520 where the plurality of fluid packages may be connected to the pump assembly 50. Each of the plurality of fluid packages may be connected to an individual pump 51A-51H within the pump assembly 50 via one of the product tubes 52A-52G.

From operation 520, where the plurality of fluid packages may be connected to the pump assembly 50, method 500 may advance to operation 530 where the agitation rack tower 20 oscillates about a pivot point relative to the agitation chassis assembly 10. The agitation device 60 may agitate the plurality of fluid packages to keep the fluid packages from stratifying.

While the present disclosure has been described in terms of particular preferred and alternative embodiments, it is not limited to those embodiments. Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

What is claimed is:

1. A housing tower, comprising:

a rack tower;

a pump assembly;

a chassis assembly including an assembly pivot, the chassis assembly configured to house the rack tower and the pump assembly, wherein the rack tower includes a tower pivot point located on the rack tower, the rack tower being configured to receive a plurality of fluid packages, and further wherein the pump assembly is adapted to fluidly connect with the plurality of fluid packages upon receipt into the rack tower, and an agitation assembly configured to agitate the rack tower relative to the chassis assembly via oscillation of a motor mount pivot point affixed to a single point on the rack tower such that the rack tower oscillates about the tower pivot point relative to the assembly pivot, wherein the chassis assembly remains stationary as the agitation assembly agitates the rack tower.

2. The housing tower of claim 1, wherein the chassis assembly comprises at least one of a control board, power and data connection to the pump assembly, and a pump electrical connection, wherein, as the agitation assembly agitates, the at least one of the control board, the power and data connection to the pump assembly, and the pump electrical connection remain stationary.

3. The housing tower of claim 2, wherein the rack tower comprises a radio frequency identification antenna, wherein the control board is coupled to the chassis assembly on a first side panel and the radio frequency identification antenna is located on a second side panel of the chassis assembly opposite to the first side panel.

4. The housing tower of claim 1, wherein the rack tower comprises slots to receive the plurality of fluid packages, wherein the plurality of fluid packages are stacked package to package, and wherein the slots are inclined at an angle of at least five degrees.

5. The housing tower of claim 1, wherein each of the plurality of fluid packages is connected to an associated individual pump.

6. A beverage system comprising:

a housing tower, including:

a rack tower;

a pump assembly;

a chassis assembly including an assembly pivot, the chassis assembly configured to house the rack tower and the pump assembly, wherein the rack tower includes a tower pivot point located on the rack tower, the rack tower being configured to receive a plurality of fluid packages, and further wherein the pump assembly is adapted to fluidly connect with the plurality of fluid packages upon receipt into the rack tower; and an agitation assembly configured to agitate the rack tower relative to the chassis assembly by oscillating a motor mount pivot point affixed to a single point on the rack tower such that the rack tower oscillates about the tower pivot point relative to the assembly pivot on the chassis assembly;

wherein the chassis assembly remains stationary as the agitation assembly agitates the single rack tower.

* * * * *